US006604714B1

(12) United States Patent
Hall

(10) Patent No.: US 6,604,714 B1
(45) Date of Patent: Aug. 12, 2003

(54) REUSABLE SUPPORT FOR DISPLAYING DISPLAY ARTICLES

(76) Inventor: Anson L. Hall, P.O. Box 87, Exeter, NH (US) 03833

( * ) Notice: Subject to any disclaimer, the term of this patent is extended or adjusted under 35 U.S.C. 154(b) by 88 days.

(21) Appl. No.: 09/589,704

(22) Filed: Jun. 8, 2000

Related U.S. Application Data

(63) Continuation-in-part of application No. 29/122,729, filed on May 2, 2000, now Pat. No. Des. 446,424.

(51) Int. Cl.[7] ..... A47G 21/14

(52) U.S. Cl. ..... 248/37.3; 211/70.6; 40/642.02; 206/553; 206/232

(58) Field of Search ..... D7/637–641; 211/13.1, 211/70.6, 70.7, 85.4; 248/37.3, 37.6, 144, 176; 40/642.02, 299.01; 206/553, 459.5, 232; 220/500, 566

(56) References Cited

U.S. PATENT DOCUMENTS

| | | | | |
|---|---|---|---|---|
| 3,704,779 A | * | 12/1972 | Nigg | 206/47 R |
| 3,899,073 A | * | 8/1975 | Barr | 206/77.1 |
| 4,834,328 A | | 5/1989 | Hall | 248/37.3 |
| 4,893,768 A | | 1/1990 | Hall | 248/37.3 |
| 4,940,199 A | | 7/1990 | Hall | 248/37.3 |
| D326,591 S | | 6/1992 | Hall | |
| 5,495,940 A | * | 3/1996 | Taniyama | 206/308.1 |
| D378,564 S | | 3/1997 | Hall | D7/637 |
| 5,839,575 A | * | 11/1998 | Blanco | 206/232 |

* cited by examiner

*Primary Examiner*—Gwendolyn Baxter
(74) *Attorney, Agent, or Firm*—Salter & Michaelson

(57) ABSTRACT

A reusable utensil support that includes an interior space adapted to receive and hold an article for display is provided.

18 Claims, 9 Drawing Sheets

REUSABLE SUPPORT FOR DISPLAYING DISPLAY ARTICLES

RELATED CASES

Priority under 35 U.S.C. §120 is hereby claimed to commonly owned and copending continuation-in-part U.S. Design Application No. 29/122,729 to Hall, Anson L., filed on May 2, 2000, which is hereby incorporated by reference in its entirety.

BACKGROUND

1. Field of the Invention

The present invention relates to a reusable support for eating utensils and, more particularly, to a reusable support for eating utensils that provides a space to display articles.

2. Related Art

It is common practice in most casual dining restaurants, other than fine dining, to provide eating utensils laid out on a bare table-top surface or, alternatively, to provide the eating utensils wrapped in a single napkin. Even if the utensils are provided wrapped up in a napkin, they most often end up on the bare table surface, while the napkin serves as a lap napkin.

Such practices can often be unsanitary since it not only can cause eating utensils to become contaminated with bacteria and/or various foreign substances, but it can also cause counter tops and table tops to become unnecessarily soiled. As a result, it has been found that the practice of placing eating utensils directly on counter tops or table tops prior to and between periods of use is unsatisfactory to many restaurant patrons, as well as to many restaurant owners and/or operators.

Attempts to overcome this problem have been disclosed in U.S. Pat. No. 227,224 to Dodge; U.S. Pat. No. 799,612 to Moore; U.S. Pat. No. 1,264,914 to Fresh; U.S. Pat. No. 2,354,968 to Pickering; U.S. Pat. No. 2,567,817 to Lunde; U.S. Pat. No. 2,615,318 to Gray; U.S. Pat. No. 2,651,927 to Mullins; U.S. Pat. No. 2,789,349 to Lee; and Design U.S. Pat. No. 196,133 to Brown. However, such references fail to disclose an effective disposable support and advertisement portion for supporting a set of eating utensils.

SUMMARY

The present invention is directed to a support for eating utensils. The support includes an elongated support frame or housing including an interior, defined by a first set and a second set of opposing interior walls. The first and second sets of walls are substantially perpendicular to one another. A central support portion is supported by the walls, and at least one aperture is disposed in the central support portion, which is adapted to receive and support an eating utensil. Opposing tabs are disposed on a first set of the opposing interior walls. Opposing ribs are disposed adjacent to the tabs. The tabs are adapted to provide support for an article insertable into the interior of the support frame and the ribs are adapted to frictionally maintain the article in a stable position in the interior of the support frame. Other objects, features and advantages of the invention shall become apparent as the description thereof proceeds when considered in connection with the accompanying illustrative drawings.

DESCRIPTION OF THE PREFERRED EMBODIMENTS

Figure 1:
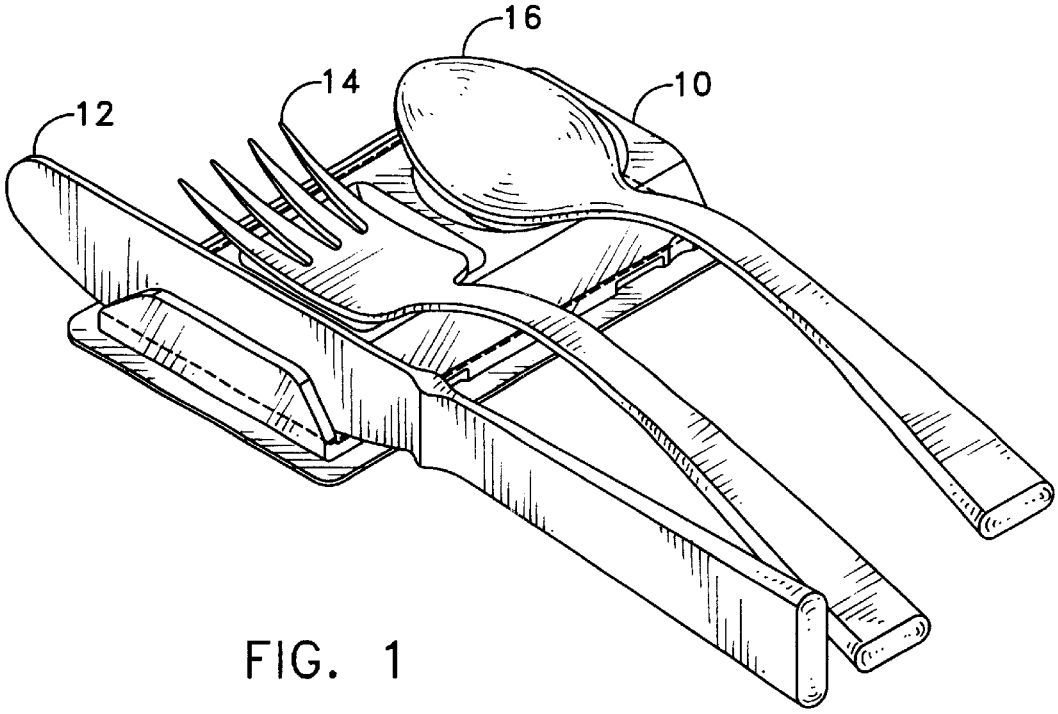
FIG. 1 is a perspective view of a one embodiment of a utensil support including an article for display.

The present invention is directed to a reusable support for eating utensils. The support provides a more hygienic manner of holding utensils than when they are placed directly on table-tops by elevating the utensils from the surface, which may be contaminated. In this manner, use of the utensil support encourages the use of a single napkin for lap use and negates the use of a placemat. This creates more table space, reduces costs associated with placemats, and is desirable for environmental reasons, as well. "Eating utensil," as used herein, means any device used to transport food to a persons' mouth, including, but not limited to, knives, forks, spoons, straws, chopsticks, toothpicks, and the like.

One embodiment of a reusable support 10 for eating utensils is illustrated with reference to FIGS. 1 through 6. As shown in perspective view in FIG. 1, utensil support 10 is adapted to support a knife 12, a fork 14, and a spoon 16. When the utensils have been removed from the support 10 as shown in FIG. 2, the support is useful for displaying articles such as, for example, business cards.

Figure 3:
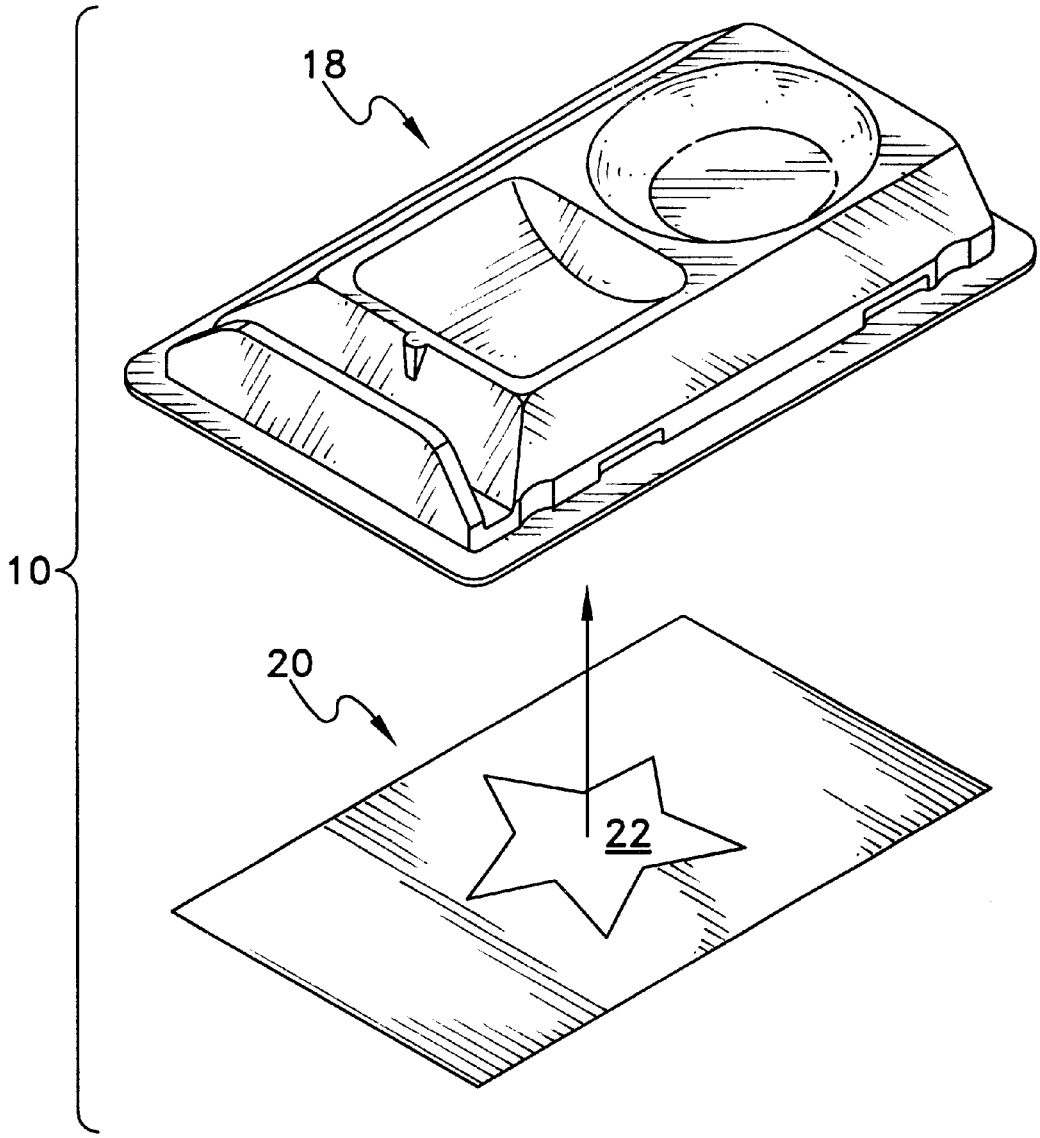
FIG. 3 is an exploded view of the utensil support of FIG. 1.

FIG. 3 illustrates utensil support 10 in an exploded view including a housing 18 (support frame) and a display article 20. Display article 20 preferably includes a logo 22 or advertisement that may be viewed through housing 18. Preferably, housing 18 is a formable material, which may be opaque, translucent, or transparent, and may have any color. In particularly preferred embodiments, the formable material is waterproof as well. When the formable material is transparent, the display articles are viewed more easily through the housing. One example of a transparent waterproof material is polycarbonate.

Figure 4:
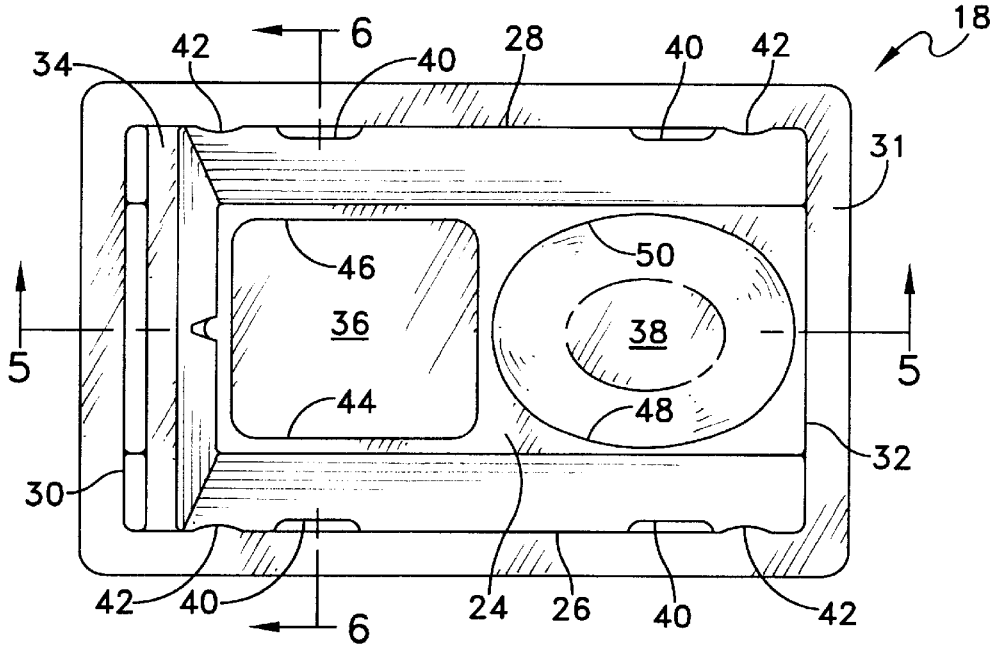
FIG. 4 is a top plan view of the cover portion of the utensil support of FIG. 1.

Housing 18 is shown in a top plan view in FIG. 4. Housing 18 includes a top surface 24, opposing front and rear walls 26, 28 and opposing left and right walls 30, 32. Top surface 24 includes three apertures 34, 36, 38 adapted to receive eating utensils, such as knife 12, fork 14, and spoon 16. Those familiar with the art will recognize that other embodiments may include fewer than or more than three apertures. Housing 18 also includes at least two tabs 40 and two ribs 42 disposed on each of the front and rear walls 26, 28 or on each of the left and right walls 30, 32.

Figure 2:
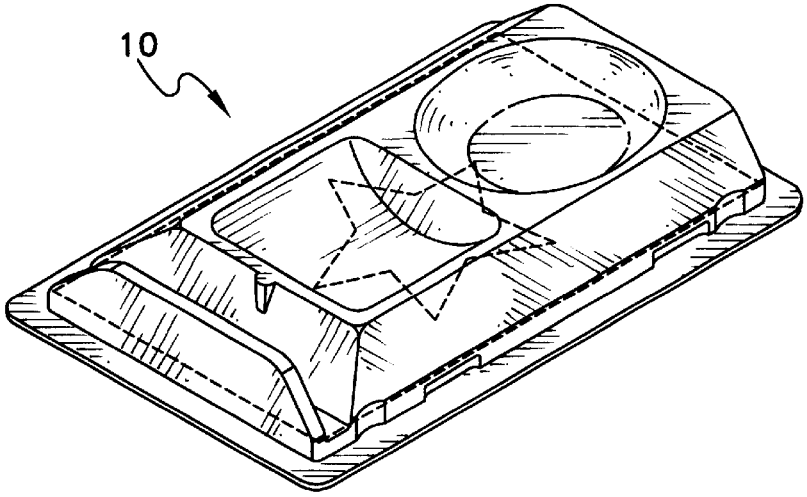
FIG. 2 is a perspective view of the utensil support of FIG. 1, showing utensils resting on a surface thereof.

Aperture 34 is configured as an elongated, narrow slot which extends in substantially perpendicular relation to the front and rear walls 26, 28 of housing 18, and may be adapted to receive and support the blade end of, for example, knife 12 in a substantially vertical on-edge disposition in the manner illustrated in FIG. 1.

Aperture 36 includes substantially straight, parallel front and rear edges 44,46 adapted to receive and support the eating end of, for example, fork 14 in the manner illustrated in FIG. 1.

Aperture 38 includes substantially arcuate front and rear edges 48, 50 adapted to receive and support the eating end of, for example, spoon 16 in the manner illustrated in FIG. 1.

Figure 5:
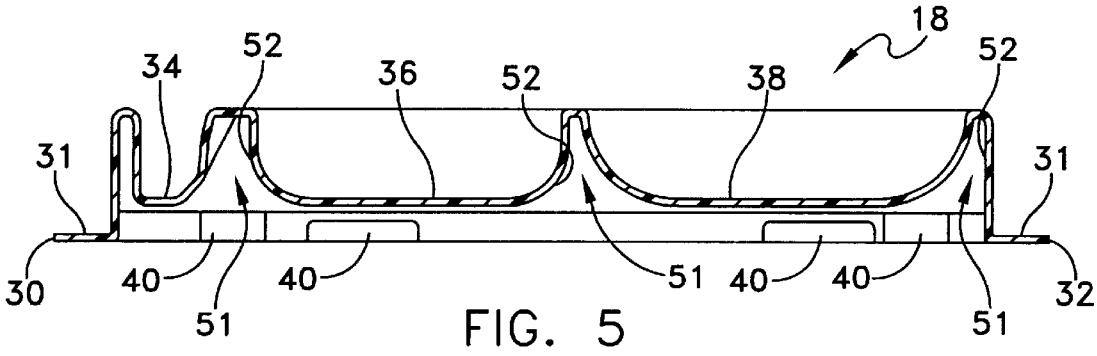
FIG. 5 is a side view of the cover portion of FIG. 4 along line 5—5.
Figure 6:
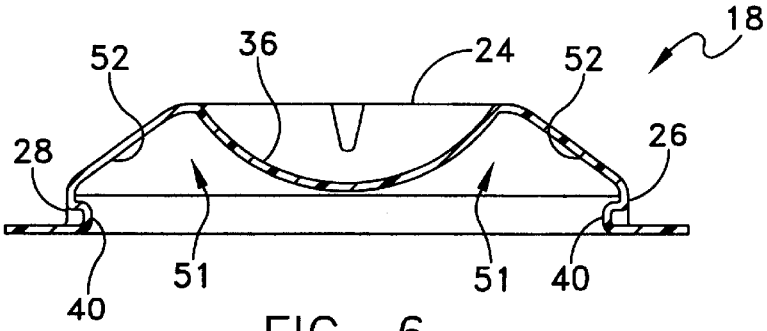
FIG. 6 is an end view of the cover portion of FIG. 4 along line 6—6.

As shown in FIGS. 5 and 6, housing 18 includes an interior space 51 having an interior surface 52. Tabs 40 and ribs 42 protrude from interior surface 52 along the front and rear walls 26, 28. Ribs 42 are adapted to frictionally receive display article 20 therein. Tabs 40 are adapted to support a display article 20 or articles and to maintain display article 20 in a spaced apart relation from a surface on which utensil support 10 may be placed.

Figure 7:
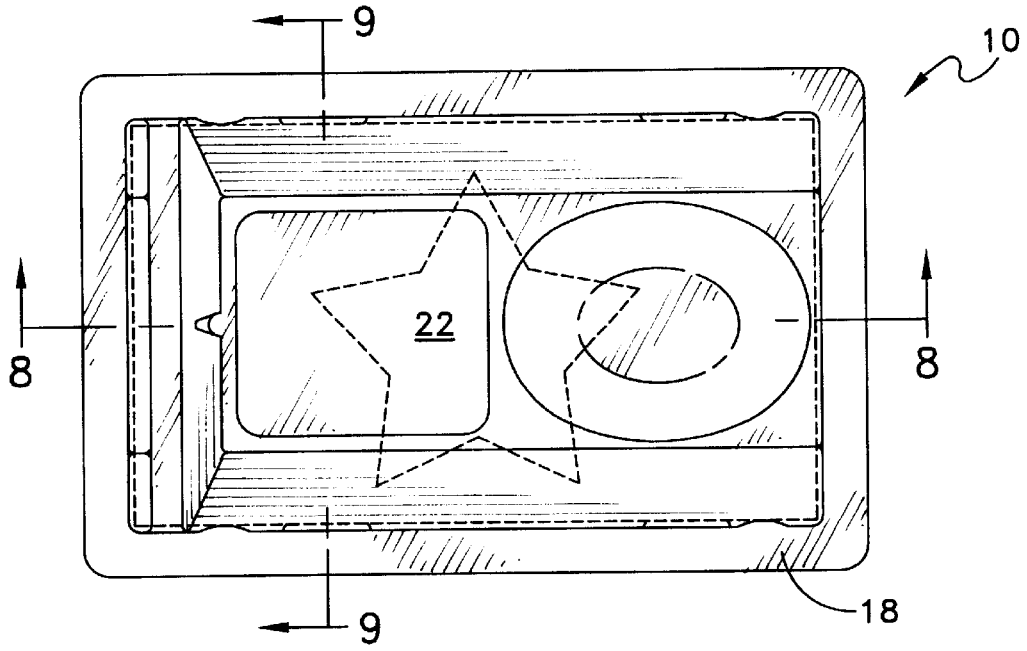
FIG. 7 is a top plan view of the utensil support of FIG. 1.
Figure 8:
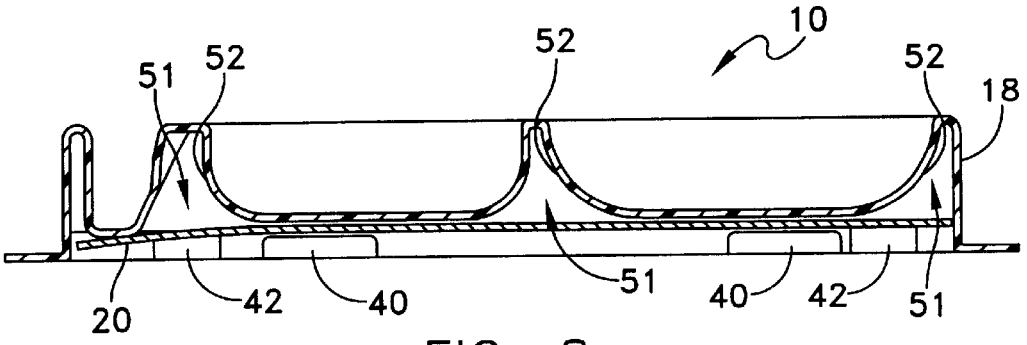
FIG. 8 is a side view of the utensil support of FIG. 7 along line 8—8.

FIGS. 7–9A illustrate a method by which utensil support 10 may be assembled. As shown, display article 20 may be inserted into housing interior space 51 until display article 20 engages ribs 40 and tabs 42, as shown in FIG. 8. Thus, when in an assembled configuration as shown in FIG. 7, indicia 22 on display article 20 may be viewed through top surface 24 of housing 18. In addition, when in a disassembled configuration, housing 18 may be placed in a dishwasher or the like for cleaning while maintaining the integrity of display article 20, which may be replaced or reused after cleaning.

Figure 9A:
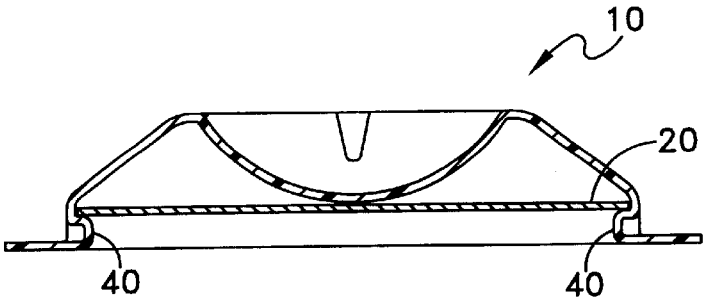
FIG. 9A is an end view of the utensil support of FIG. 7 along line 9—9.
Figure 9B:
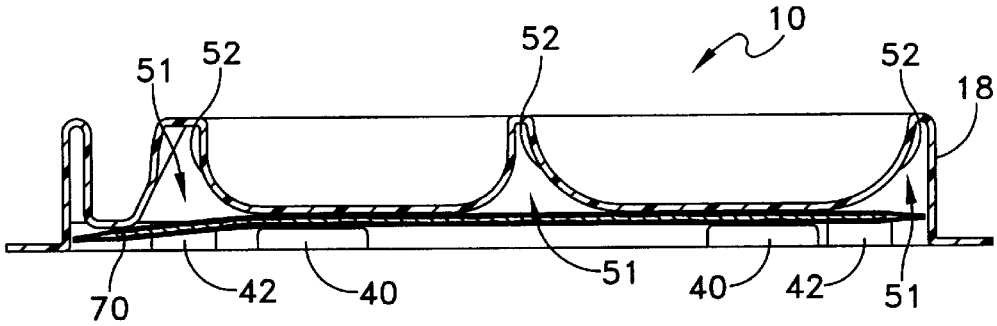
FIG. 9B is an end view of the utensil support of FIG. 7, further including a cleansing wipe supported within the interior.

FIG. 9B shows another embodiment of utensil support 10 (first shown in FIGS. 5–9A), including a cleansing wipe 70 disposed within interior 51 of housing 18 and supported on opposing tabs 40.

Figure 9C:
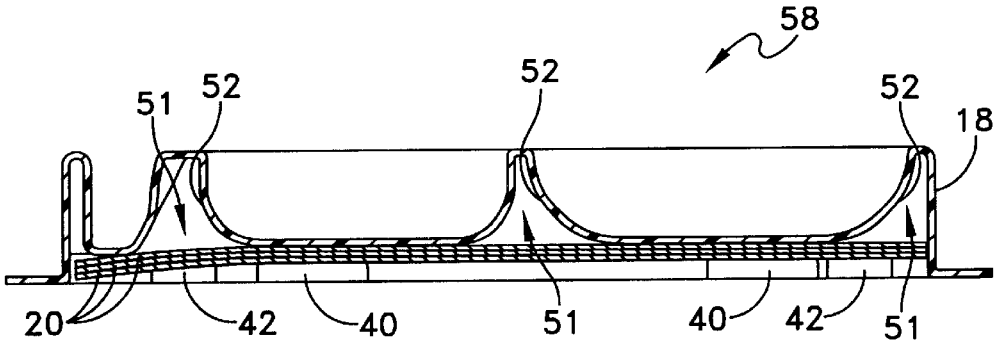
FIG. 9C is an end view of the utensil support of FIG. 7 including a plurality of display articles supported within the interior of the utensil support.

FIG. 9C shows another embodiment of utensil support 10 (first shown in FIGS. 5–9A), including a plurality of display articles 20 disposed within interior 51 of housing 18 and supported on opposing tabs 40.

Thus, the present embodiment provides a utensil support that may be disassembled for cleaning the housing, while maintaining the integrity of display article 20, which may be replaced or reused after cleaning.

Figure 10:
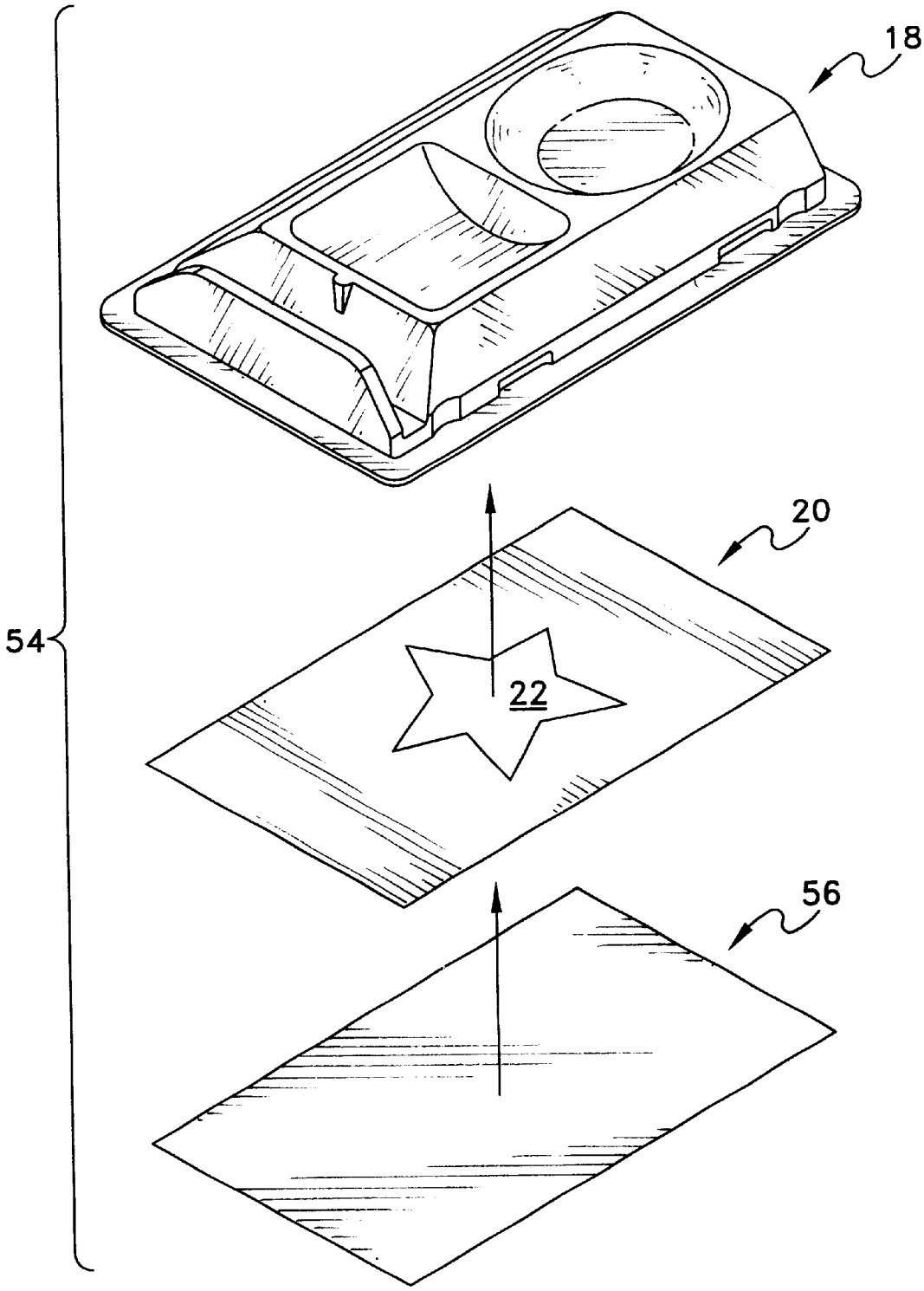
FIG. 10 is an exploded view of another embodiment of a utensil support including a cover and a protective backing.

FIG. 10 is an exploded view of another embodiment of a utensil support 54, which includes a protective base cover 56 adapted to be received within interior space 51 of housing 18. As in the previous embodiment, housing 18 is preferably formed from a transparent material to allow viewing of display article 20. In the present embodiment, protective base cover 56 may also be a transparent material, preferably a waterproof transparent material, which will provide some protection to display article 20 from liquids.

Figure 11:
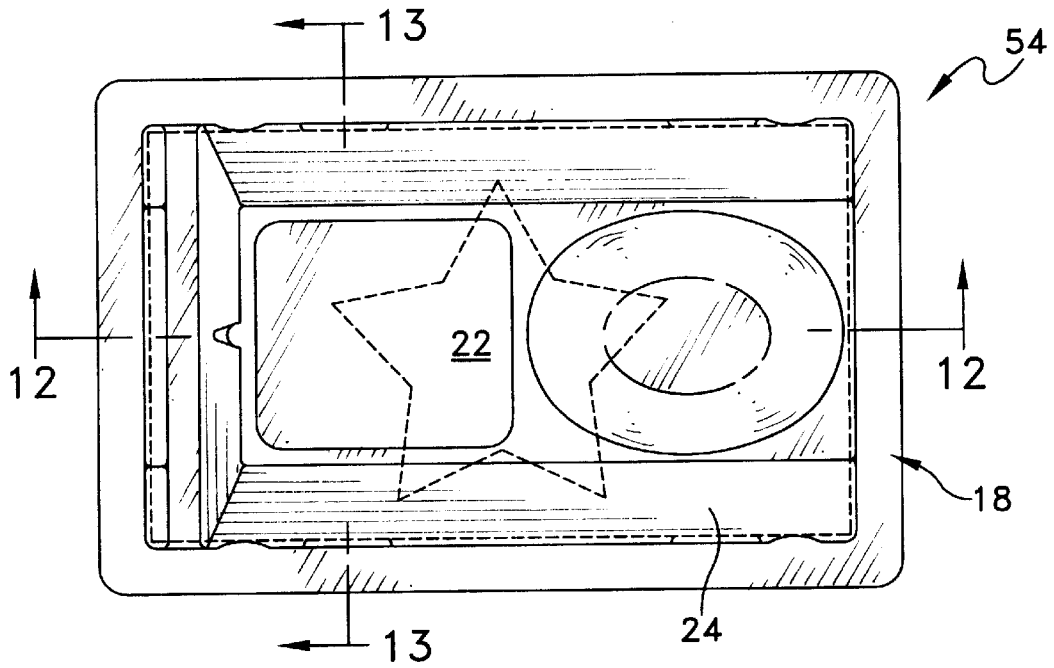
FIG. 11 is a top plan view of the utensil support of FIG. 10.
Figure 12:
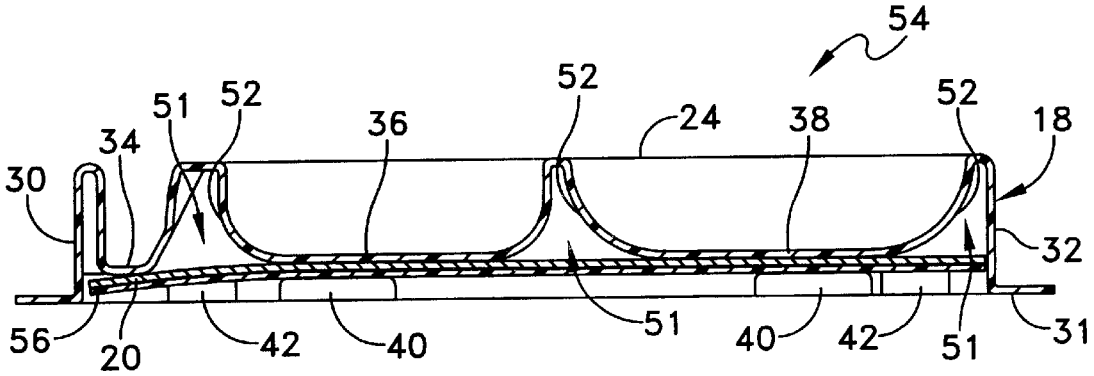
FIG. 12 is a side view of the utensil support of FIG. 11 along line 12—12.
Figure 13:
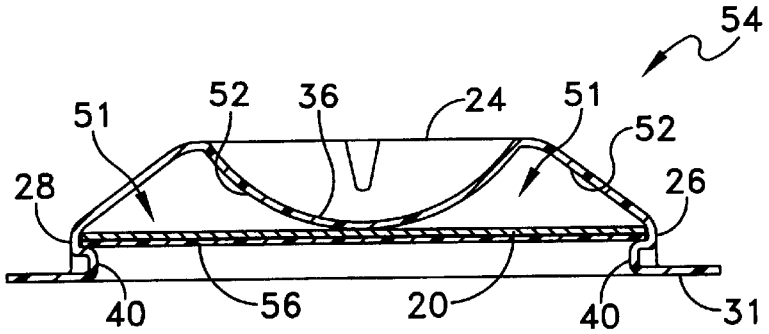
FIG. 13 is an end view of the utensil support of FIG. 11 along line 13—13.
Figure 14:
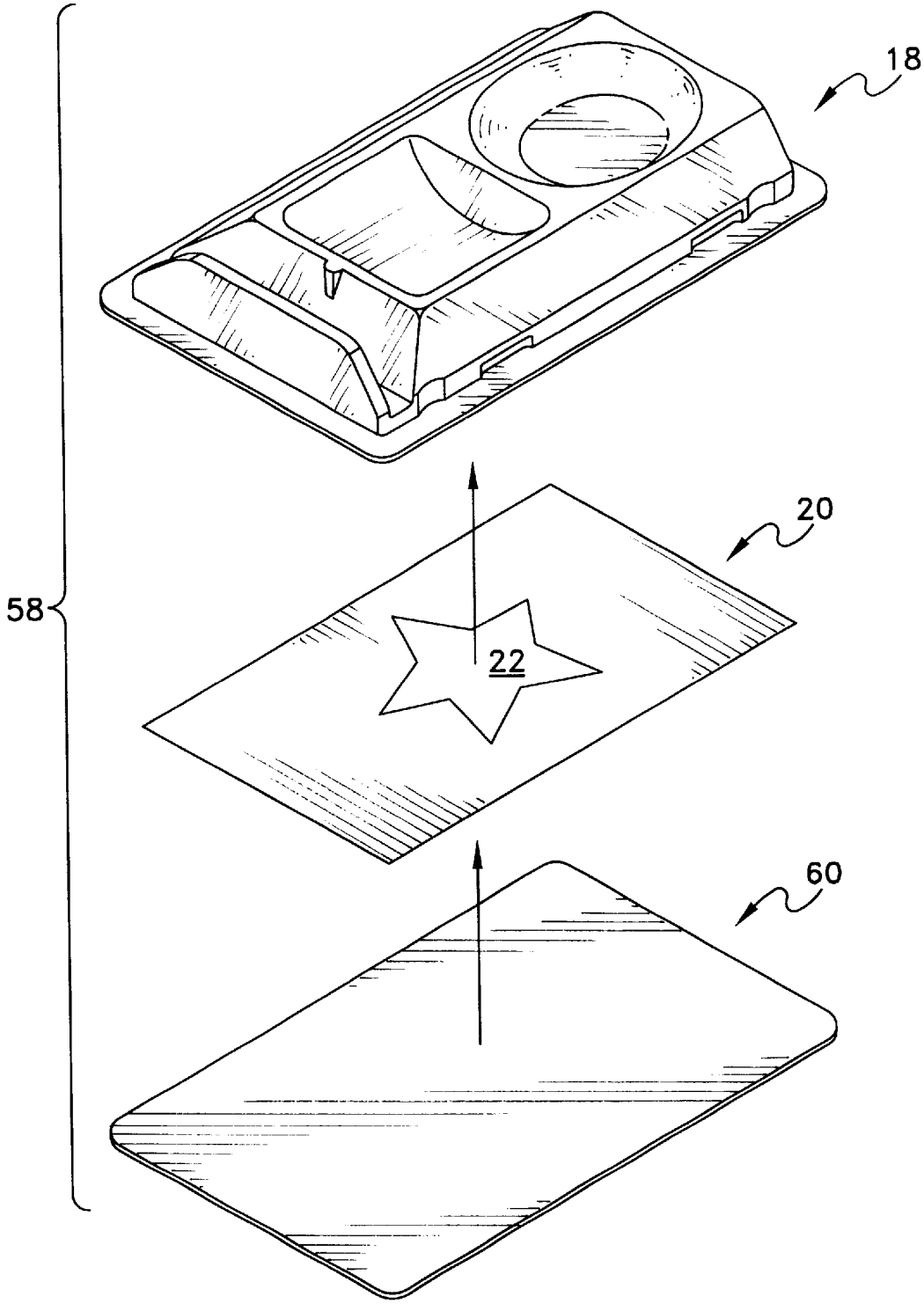
FIG. 14 is an exploded view of another embodiment of a utensil support including a cover, an article for display, and an attached protective backing.

FIGS. 11–13 illustrate a method by which utensil support 54 may be assembled. As shown, both display article 20 and protective base cover 56 are inserted into interior space 51 of housing 18 until display article 20 and protective base cover 56 engage tabs 40 and ribs 42, as shown in FIG. 12. Thus, when in an assembled configuration as shown in FIG. 11, indicia 22 on display article 20 may be viewed through top surface 24 of housing 18.

Thus, the present embodiment provides a utensil support that may be disassembled for cleaning the housing and the protective display article cover, while maintaining the integrity of display article 20, which may be replaced or reused after cleaning.

Another embodiment of a utensil support 58 is shown in FIGS. 14–17, including a display article 20 and a protective base cover 60 adapted to be attached directly to housing 18. As in the previous embodiments, housing 18 is preferably formed from a transparent material to allow viewing of display article 20. Preferably, protective base cover 60 may be a transparent material, preferably a waterproof transparent material, which will provide some protection to display article 20 from liquids.

Figure 15:
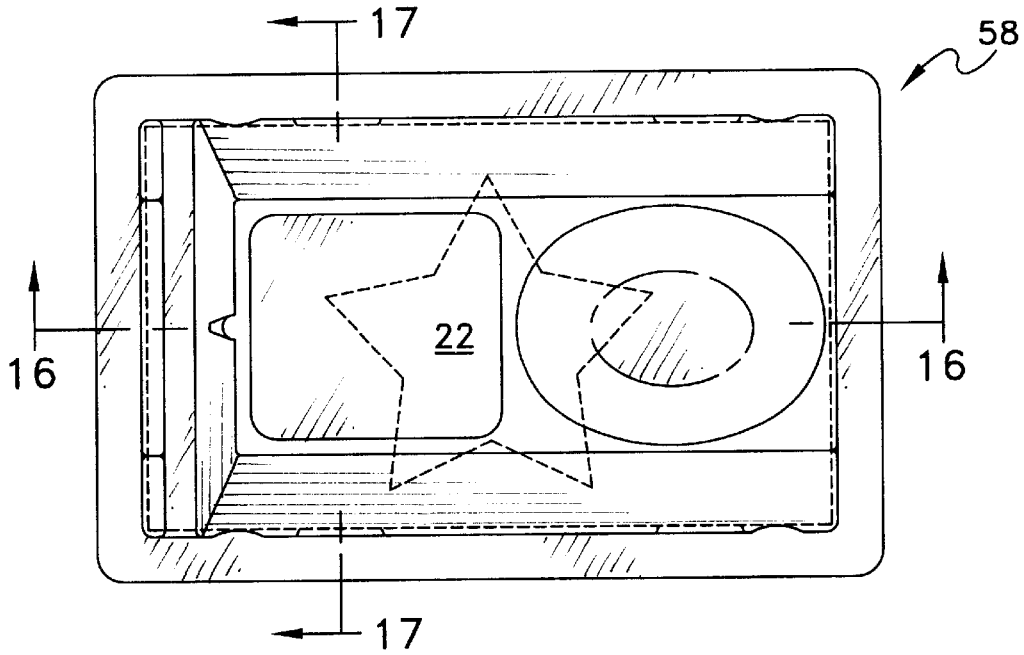
FIG. 15 is a top plan view of the utensil support of FIG. 14.
Figure 16:
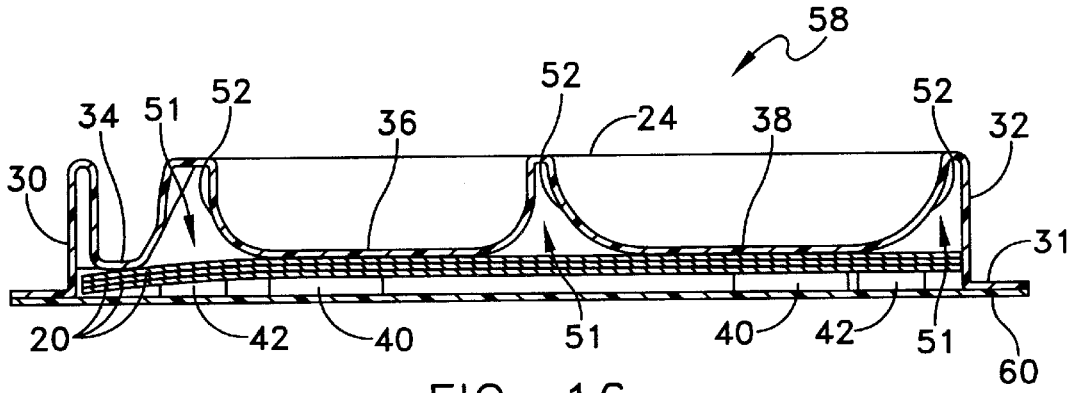
FIG. 16 is a side view of the utensil support of FIG. 15 along line 16—16.
Figure 17:
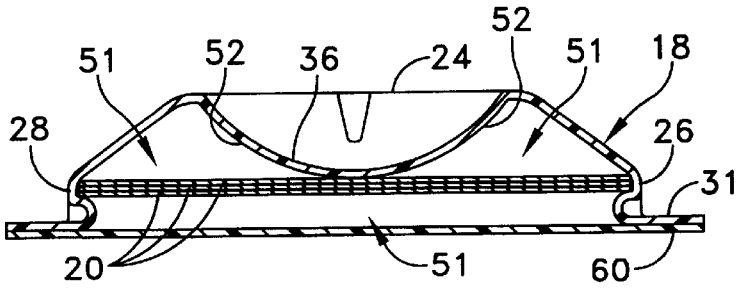
FIG. 17 is an end view of the utensil support of FIG. 15 along line 17—17.

FIGS. 15–17 illustrate a method by which utensil support 58 may be assembled. As shown in FIG. 16, display article 20 is inserted into interior space 51 of housing 18 until display article 20 engages tabs 40 and ribs 42, as shown in FIG. 12. Protective base cover 60 may be attached directly to flange 31. The attachment of protective base cover 60 to flange 31 may be effected by various methods such as, for example, gluing, crimping, heat sealing, and the like. In preferred embodiments, protective base cover 60 is attached by heat -sealing so as to provided and air- and water-tight seal.

WORKING EXAMPLES

Example 1

A business card was positioned in the housing of a utensil support. The card was positioned to rest on the tabs and to be frictionally held in place by the ribs. A backing piece formed of the same material as the housing is inserted into the housing in the same manner.

Example 2

The support of Example 1 was refined to include a protective base cover secured to the bottom flange to prevent water or any other liquid from entering the utensil support and ruining the business card positioned therein. The backing portion was a laminated material that was heat sealed to the flange. Thus, the present support provided a water- and liquid-proof utensil support that allows display of business cards or the like, and that can be washed without contaminating the advertisement or business card contained therein.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A support for eating utensils, comprising:

an elongated support frame including an interior, defined by a first set and a second set of opposing interior walls, the first set of walls being substantially perpendicular to the second set of walls, each set of walls having an upper edge and a lower edge, the upper edge intersecting the support frame;

a central support portion supported by the walls;

at least one recess disposed in the central support portion, the recess being adapted to receive and support an eating utensil;

opposing tabs disposed on the first set of the opposing interior walls, the opposing tabs including a support region spaced apart from the upper and lower edge; and opposing ribs disposed adjacent the tabs;

wherein the tabs are adapted to provide support for an article insertable into the interior of the support frame and the ribs are adapted to frictionally maintain the article in a stable position in the interior of the support frame.

2. The support of claim 1, further comprising a flange extending outwardly from the walls around the perimeter of the frame, wherein the flange includes a bottom surface.

3. The support of claim 2, wherein the support is molded from a transparent plastic material.

4. The support of claim 3, further comprising at least one display article disposed within the interior and supported on the opposing tabs.

5. The support of claim 4, further comprising a first backing piece, disposed within the interior and supported on the opposing tabs.

6. The support of claim 5, further comprising a cleansing wipe disposed within the interior and supported on the opposing tabs.

7. The support of claim 6, wherein the first backing piece is formed from a waterproof material.

8. The support of claim 7, further comprising a second backing piece adapted to be attached to the bottom surface of the flange.

9. The support of claim 8, wherein the frame and the second backing piece are formed from a transparent plastic material, and the second backing piece is heat-sealed to the bottom surface of the flange.

10. The support of claim 9, wherein the at least one display article is a business card.

11. The support of claim 1, further comprising a plurality of display articles disposed within the interior and supported on the opposing tabs.

12. The support of claim 1, further comprising a first backing piece disposed within the interior and supported on the adjacent tabs.

13. The support of claim 12, further comprising at least one display article disposed within the interior and adjacent to the first backing piece.

14. The support of claim 13, further comprising a cleansing wipe disposed within the interior and adjacent to the at least one display article.

15. The support of claim 14, further comprising the first backing piece is formed from a waterproof material.

16. The support of clam 15, further comprising a second backing piece, and wherein the frame and the second backing piece are formed from a transparent plastic material, and the second backing piece is heat-sealed to the bottom surface of the flange.

17. The support of claim 16, wherein the at least one display article is a business card.

18. A support for eating utensils, comprising:

a central support portion having an outer surface, the outer surface including at least one support region constructed and arranged to receive and support an eating utensil;

a first set and a second set of opposing sidewalls extending downwardly from the central support portion and defining an interior, the opposing sidewalls having an upper edge intersecting the central support portion, a lower edge, and an interior surface;

opposing tabs disposed on the interior surface of the first set of the opposing sidewalls, the opposing tabs having an upper support surface spaced apart from the upper and lower edges of the opposing sidewalls; and opposing ribs disposed adjacent to the opposing tabs on the interior surface of the first set of the opposing sidewalls;

wherein, upon insertion of an article into the interior, the article is supported on the upper support surface of the tabs and maintained in spaced relation from the lower edge of the tabs, and the article is further frictionally maintained between the interior surfaces of the first set of opposing sidewalls.

* * * * *